US011933000B2

(12) United States Patent
Patterson

(10) Patent No.: US 11,933,000 B2
(45) Date of Patent: Mar. 19, 2024

(54) DEPTH GUIDE FOR PAVING MACHINE

(71) Applicant: Samuel C. Patterson, Rockport, ME (US)

(72) Inventor: Samuel C. Patterson, Rockport, ME (US)

( * ) Notice: Subject to any disclaimer, the term of this patent is extended or adjusted under 35 U.S.C. 154(b) by 760 days.

(21) Appl. No.: 17/069,076

(22) Filed: Oct. 13, 2020

(65) Prior Publication Data

US 2022/0112670 A1 Apr. 14, 2022

(51) Int. Cl.
*E01C 23/01* (2006.01)
*E01C 19/48* (2006.01)

(52) U.S. Cl.
CPC ..... *E01C 23/01* (2013.01); *E01C 19/4866* (2013.01); *E01C 2301/00* (2013.01)

(58) Field of Classification Search
None
See application file for complete search history.

(56) References Cited

U.S. PATENT DOCUMENTS 39,161 A * 7/1863 Naglee ..... G01F 23/0023 33/719
3,352,017 A * 11/1967 Newberg ..... G01C 13/008 114/294
3,745,658 A * 7/1973 Raneses ..... B01J 19/2425 33/1 V
3,813,181 A * 5/1974 Barnes, III ..... E01C 19/008 172/430
4,135,304 A * 1/1979 Kuntz ..... G01C 7/04 33/523
4,687,220 A * 8/1987 Danielson ..... B60D 1/36 116/28 R
4,948,292 A * 8/1990 Haven ..... E01C 19/008 404/84.2
5,094,001 A * 3/1992 Fraser ..... A01B 69/001 33/624
5,317,813 A * 6/1994 Reed ..... G01B 3/08 33/809
5,549,412 A * 8/1996 Malone ..... E01C 19/004 404/84.2
6,119,353 A * 9/2000 Grønskov ..... G01M 5/0091 73/146
6,298,574 B1 * 10/2001 Baker ..... G01B 5/061 33/1 H
6,430,826 B1 * 8/2002 Sigl ..... G01C 15/10 33/408
6,729,596 B2 * 5/2004 Fumado Gilabert . E01C 19/004 248/550
6,732,445 B1 * 5/2004 Scoville ..... F16L 55/18 33/645

(Continued)

FOREIGN PATENT DOCUMENTS

CN 107245928 A * 10/2017 ..... E01C 23/01
CN 112815811 A * 5/2021 ..... G01B 5/0025

(Continued)

*Primary Examiner* — George B Bennett
(74) *Attorney, Agent, or Firm* — Anthony D. Pellegrini

(57) ABSTRACT

A depth guide to be used with a road paving machine having a movable screed, said depth guide allowing the operator of the road paving machine a simple means for visually assessing whether the pavement layer being deposited by the road paving machine and formed by the screed is of the proper thickness.

20 Claims, 5 Drawing Sheets

(56) References Cited

U.S. PATENT DOCUMENTS

| | | | | |
|---|---|---|---|---|
| 7,788,049 | B2 * | 8/2010 | Bryant | G01V 1/22 702/57 |
| 8,162,565 | B2 * | 4/2012 | Speers | E01C 19/48 403/2 |
| 8,220,174 | B1 * | 7/2012 | Shwaiheen | G01B 5/25 33/529 |
| 8,591,141 | B2 * | 11/2013 | Owegeser | E01C 19/48 404/84.1 |
| 8,696,237 | B2 * | 4/2014 | Hanfland | G01B 21/08 404/84.1 |
| 8,763,270 | B1 * | 7/2014 | Spear, IV | G01B 3/28 33/518 |
| 8,794,867 | B2 * | 8/2014 | Snoeck | E01C 23/07 404/90 |
| 9,033,611 | B2 * | 5/2015 | Hanfland | G01B 21/18 404/84.1 |
| 9,587,937 | B2 * | 3/2017 | Buschmann | B60W 30/12 |
| 10,407,845 | B1 * | 9/2019 | Downing | E01C 19/4853 |
| 11,148,216 | B1 * | 10/2021 | Carper | B23Q 17/2225 |
| 11,560,675 | B2 * | 1/2023 | Buschmann | E01C 19/185 |
| 11,572,663 | B2 * | 2/2023 | Weiler | E01C 19/4873 |
| 11,613,856 | B2 * | 3/2023 | Doy | E01C 23/127 299/1.5 |
| 2008/0244921 | A1 * | 10/2008 | Silberman | G01B 5/0025 33/832 |

FOREIGN PATENT DOCUMENTS

| | | | | |
|---|---|---|---|---|
| KR | 2185769 | B1 * | 12/2020 | E01C 23/01 |
| WO | WO-2018114669 | A1 * | 6/2018 | E01C 19/48 |

* cited by examiner

DEPTH GUIDE FOR PAVING MACHINE

BACKGROUND OF INVENTION

The present invention relates generally to the construction industry and more specifically to the road building industry. In particular, the present invention is a depth guide to be used with a road paving machine to allow the operator of the road paving machine a simple means for visually assessing whether the pavement layer being created by the road paving machine is of the proper thickness.

A road paving machine typically includes a tractor component and a movable screed component. The tractor component tows the screed behind it during operation. As the road paving machine moves along the roadbed, it deposits road paving material, typically asphalt, concrete, loose aggregates, and the like, onto the roadbed. The screed passes over the road paving material and flattens it into a pavement layer of desired thickness. Because road paving material is expensive, and because so much of it is used when paving a roadway, even small deviations from the specified thickness can result in significant cost overruns, or conversely, insufficient pavement durability if too little is used.

While the screed is initially set to the proper height, as the road paving machine moves over the roadbed the initial setting may no longer be correct. Variations in the roadbed, such as dips and bulges, can cause the height of the screed over the roadbed to vary, such that the layer of pavement formed by the screed is of the wrong thickness. If the height of the screed becomes too low for the condition of the roadbed, the pavement layer will be too thin and subject to failure. If the height of the screed becomes too high for the condition of the roadbed, the pavement layer will be too thick, thereby wasting road paving material and increasing costs. An experienced operator may be able to visually determine whether the height of the screed is properly set for the variable condition of the roadbed, and can then dynamically reset the height of the screed if required to set the correct thickness of the pavement layer being laid down. However, this is not an easy skill to acquire, and many operators, especially novices, are incapable of properly assessing the height of the pavement layer being created by the screed.

Because of this, there are a multitude of devices employed in the industry to detect the thickness of the pavement layer created by the screed. Most of these are electronic devices which use some combination of transmitters of sonic waves, such as ultrasound waves, or optical waves, such as lasers, together with sensors adapted to receive those waves and processors to convert the data into distance measurements, to determine the thickness of the pavement layer. While these devices work, they are complicated and very expensive and are not often found on smaller road paving machines.

What is thus needed is an inexpensive, simple device that allows the operator of a road paving machine to easily determine whether the pavement layer created by the screed is of the appropriate thickness so that adjustment of the screed can be made if necessary.

It is therefore an object of the present invention to provide a pavement depth guide for use on a road paving machine that can provide a visual indicator of the thickness of the pavement layer created by the screed to the operator of the road paving machine.

It is yet a further object of the present invention to provide a pavement depth guide for use on a road paving machine that is inexpensive and easy to use.

It is yet a further object of the present invention to provide a pavement depth guide for use on a road paving machine which is simple in design.

It is yet a further object of the present invention to provide a pavement depth guide for use on a road paving machine that does not require electronic components.

It is yet a further object of the present invention to provide a pavement depth guide for use on a road paving machine which may be used on any design of a road paving machine employing a movable screed.

Other objects of the present invention will be readily apparent from the description that follows.

SUMMARY OF INVENTION

In one aspect, the present invention is a mechanical device that the operator of a road paving machine visually perceives during operation of the road paving machine, whereby the perceived proximity of the device to the roadbed provides the operator with information regarding the thickness of the road paving material being deposited onto the roadbed and formed into a pavement layer by the screed. The device comprises an attachment component which attaches the device to the screed of the road paving machine, and a depth indicator which extends downward from the attachment component towards the roadbed. In one embodiment, the device further comprises a weighted distal indicator, which is suspended from the bottom of the depth indicator and which facilitates the operator viewing the proximity of the device to the roadbed. In another embodiment the device further comprises an extension arm, which holds the depth indicator away from the attachment component to better facilitate the operator viewing the proximity of the device to the roadbed. In yet another embodiment, the device further comprises a depth control gauge, which allows for initial adjustment of the overall length of the depth indicator, to correspond with the desired thickness of the pavement layer.

Additional features and advantages of the invention will be set forth in the description which follows, and will be apparent from the description, or may be learned by practice of the invention. The foregoing general description and the following detailed description are exemplary and explanatory and are intended to provide further explanation of the invention

BRIEF DESCRIPTION OF THE DRAWING

The accompanying drawings are included to provide a further understanding of the invention and are incorporated into and constitute a part of the specification. They illustrate various embodiments of the invention and, together with the description, serve to explain the principles of the invention.

DETAILED DESCRIPTION OF THE PRESENT INVENTION

Figure 5:
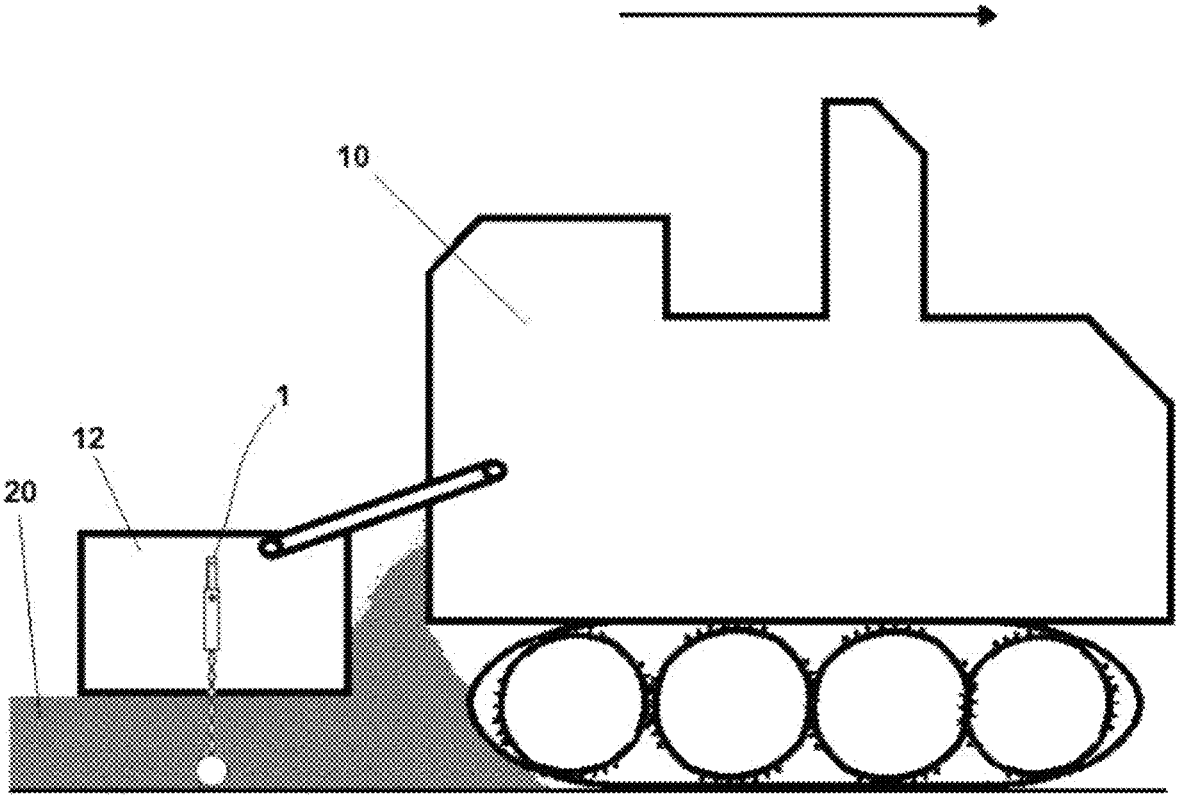
FIG. 5 is a plan side view of the embodiment of the present invention depicted in FIG. 1 attached to the side of a stylized screed being towed by a stylized road paving machine.

The depth guide 1 of the present invention is intended to be used with a road paving machine 10 having a movable screed 12 attached thereto. The road paving machine 10 is capable of depositing road paving material 20 onto a roadbed 30. The screed 12 is adjustable in height to control the thickness of the pavement layer formed from the road paving material 20 deposited onto the roadbed 30. See FIG. 5.

Figure 1:
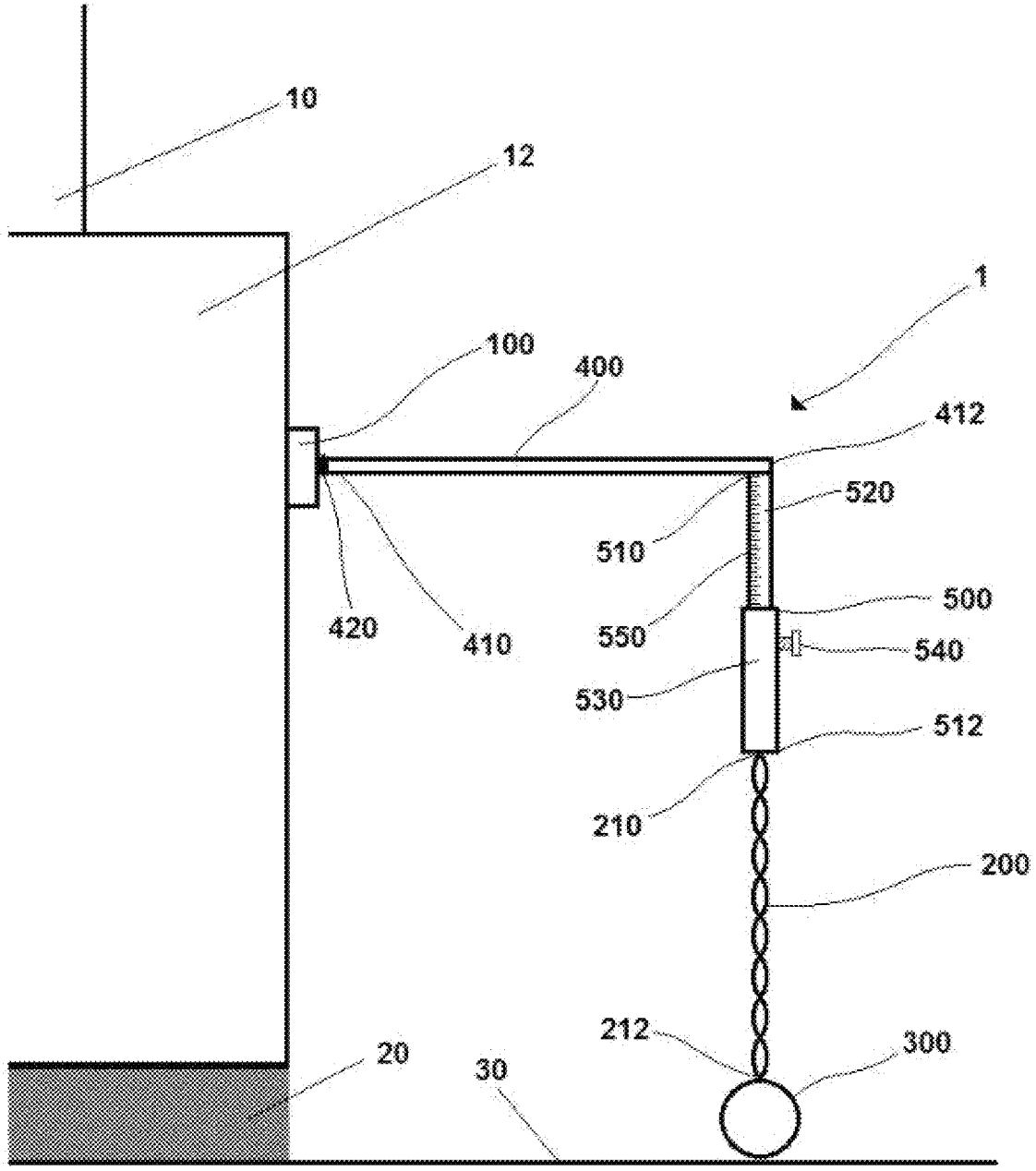
FIG. 1 is a plan rear view of one embodiment of the present invention, depicting the depth guide of the present invention attached to the side of a stylized screed being towed by a stylized road paving machine.

The depth guide 1 of the present invention comprises an attachment component 100 and a depth indicator 200. See FIG. 1. The attachment component 100 is adapted to attach the depth guide 1 to the screed 12. The attachment component 100 may be configured in any suitable way that achieves its functional purpose, such as a metal plate. In the preferred embodiment the attachment component 100 is fixedly attached to the screed 12. In this embodiment the attachment component 100 may be attached to the screed 12 by one or more mechanical fasteners, such as bolts or rivets, or by one or more welds. Alternatively, any known means for attaching the attachment component 100 to the screed 12 as is known in the art may be used.

The depth indicator 200 is elongate and has a length, a proximate end 210, and a distal end 212. The depth indicator 200 is attached to the screed 12 by the attachment component 100. The depth indicator 200 extends in a downward direction from the attachment component 100 towards the roadbed. It is attached to the attachment component 100 at its proximate end 210.

The length of the depth indicator 200 is such that when the screed 12 is positioned at a height for forming a pavement layer having a desired thickness, the distal end 212 of the depth indicator 200 hangs just over the unpaved roadbed 30. As such, the distal end 212 of the depth indicator 200 is visually perceived by the operator of the road paving machine 10 during operation of the road paving machine 10. The proximity of the distal end 212 of the depth indicator 200 to the roadbed 30 provides the operator with information regarding the thickness of the road paving material 20 being deposited onto the roadbed 30 and formed by the screed 12 into a pavement layer. The distal end 212 of the depth indicator 200 laying on the roadbed 30 indicates the pavement layer is too thin, and the distal end 212 of the depth indicator 200 dangling too far above the roadbed 30 indicates the pavement layer is too thick.

In the preferred embodiment, the depth indicator 200 is flexible. It may be formed of a length of metal cable, or from a nylon cord, or from rope, or any other elongate flexible material. In the most preferred embodiment the depth indicator 200 is a length of chain. Chain is preferred for its durability and weight, allowing it to readily hang in a downward direction. In an alternate embodiment, the depth indicator 200 may be inflexible, such as a metal rod. In such cases the depth indicator 200 is attached at its proximate end 210 by a pivot or hinge, so that if the pavement layer being formed by the screed 12 is too thin the distal end 212 of the depth indicator 200 will lay along the roadbed 30 at an angle.

In one embodiment of the present invention, the depth guide 1 further comprises a distal indicator 300. See FIG. 1. The distal indicator 300 is attached to the distal end 212 of the depth indicator 200. It has a greater dimension than the distal end 212 of the depth indicator 200, thereby making it easier to view by the operator of the road paving machine 10 during operation. The distal indicator 300 may have any shape and size as is practical. In one embodiment the distal indicator 300 is spherical, though it may also be cubic, semi-spherical, pyramidal, or of an irregular shape. In the preferred embodiment the distal indicator 300 is made of metal. Where the depth indicator 200 is flexible, the distal indicator 300 should have sufficient mass to extend the depth indicator 200 substantially to its full length. The vertical dimension of the distal indicator 300 is taken into account when establishing the length of the depth indicator 200.

In yet another embodiment of the present invention, the depth guide 1 further comprises an extension arm 400. See FIG. 1. The extension arm 400 is elongate and has a proximate end 410 and a distal end 412, and is oriented substantially horizontally. The extension arm 400 is interposed between the attachment component 100 and the depth indicator 200. The proximate end 410 of the extension arm 400 is attached to the attachment component 100 and the proximate end 210 of the depth indicator 200 is attached to the distal end 412 of the extension arm 400. As such, the extension arm 400 is adapted to position the depth indicator 200 away from the screed 12 so that the operator of the road paving machine 10 can more easily visually perceive the distal end 212 of the depth indicator 200, or the distal indicator 300 if one is used. In the preferred embodiment the extension arm 400 is a metal rod. Other configurations of the extension arm 400 are also contemplated, and it could be made of plastic, composites, or any rigid, durable material.

While the extension arm 400 of the depth guide 1 may extend outward at a fixed angle to the screed 12, such as substantially perpendicular to the screed 12, in the preferred embodiment the extension arm 400 is pivotally attached to the attachment component 100. The pivotal attachment allows the distal end 412 of the extension arm 400 to swing both away from and towards the screed 12. This allows the depth guide 1 to be placed flush against the screed 12 when not being used. In the preferred embodiment the distal end 412 of the extension arm 400 moves in a substantially horizontal plane. In alternative embodiments, the extension arm 400 moves in a substantially vertical plane. The pivotal attachment may be a hinge or a ball and socket joint or any other arrangement known in the art to allow the extension arm 400 to pivot in relation to the screed 12. In another embodiment, the pivotal attachment is lockable, so that when the extension arm 400 is placed flush against the screed 12 it remains in place, and when it is extended away from the screed 12 it remains in place. Any known locking mechanism known in the art is contemplated. In an alternate embodiment the extension arm 400 may be comprised of two or more sub-arms, with the sub-arms pivotally connected to each other. As the sub-arms are unfolded, the extension arm 400 is extended away from the screed 12.

In yet another embodiment of the present invention, the depth guide 1 further comprises a depth control gauge 500. The depth control gauge 500 is used to set the overall vertical length of the depth guide 1 when the depth guide 1 is fixedly attached to the screed 12. The depth control gauge 500 is elongate and has a proximate end 510 and a distal end 512. It has an adjustable length and is oriented substantially vertically. The depth control gauge 500 is interposed between the distal end 412 of the extension arm 400 and the proximate end 210 of the depth indicator 200, with the proximate end 510 of the depth control gauge 500 being attached to the distal end 412 of the extension arm 400 and with the proximate end 210 of the depth indicator 200 being attached to the distal end 512 of the depth control gauge 500. See FIG. 1. The length of the depth control gauge 500 is taken into account when establishing the length of the depth indicator 200.

Figure 2A:
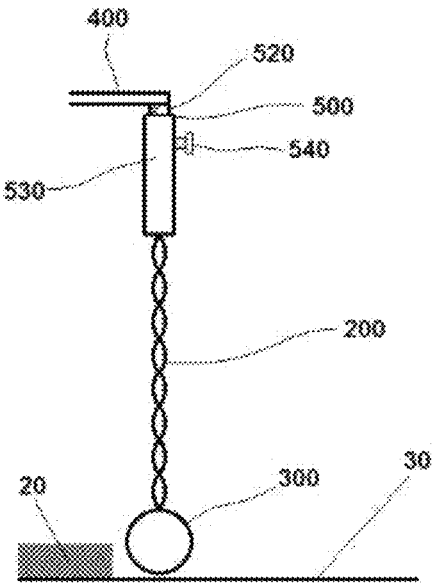
FIG. 2A depicts the embodiment of the present invention shown in FIG. 1, with the depth control gauge set at minimal height, corresponding to the screed forming a thin pavement layer.
Figure 2B:
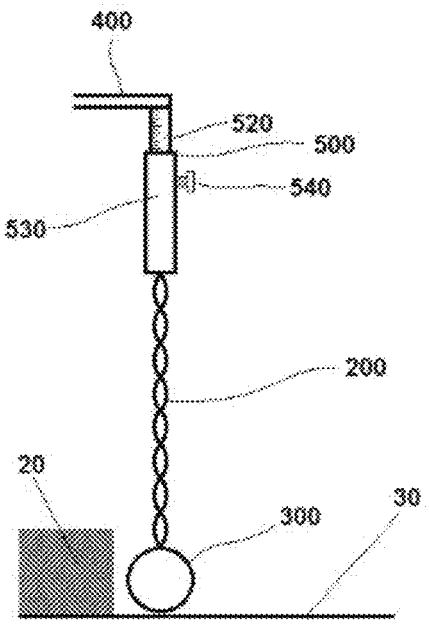
FIG. 2B depicts the embodiment of the present invention shown in FIG. 1, with the depth control gauge set at an intermediate height, corresponding to the screed forming a pavement layer of intermediate thickness.
Figure 2C:
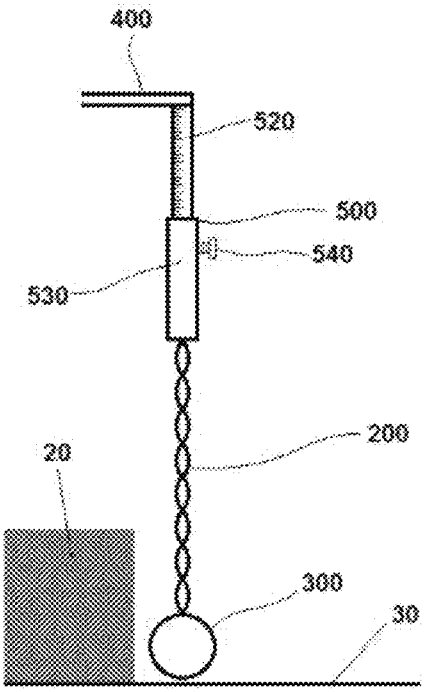
FIG. 2C depicts the embodiment of the present invention shown in FIG. 1, with the depth control gauge set at maximal height, corresponding to the screed forming a thick pavement layer.

The depth control gauge 500 has associated therewith a first length and a second length, with the second length being longer than the first length. It has a means for adjusting its overall length to the first length or to the second length, and to any intermediate length between the first and second lengths. In selecting the appropriate length, the depth control gauge 500 sets the overall vertical length of the depth guide 1. The depth control gauge 500 further has a means for fixing its length at the length to which it is adjusted, so that it remains at the selected length during use. In practice, first the screed 12 is adjusted to its desired height above the roadbed 30, then the length of the depth control gauge 500 is adjusted to set the position of the distal end 212 of the depth indicator 200 (or the bottom of the distal indicator 300) to just above the roadbed, then that desired length is fixed. FIG. 2A shows the depth control gauge 500 when it is set to its minimal overall length, corresponding to a pavement layer having minimal thickness. When a thicker pavement layer is desired, the screed 12 is positioned higher, and so the depth control gauge 500 is lengthened to an intermediate length, as shown in FIG. 2B. When the thickest pavement layer is desired, the screed 12 is positioned at its highest position and the depth control gauge 500 is lengthened to its maximum length, as shown in FIG. 2C.

In the preferred embodiment, the depth control gauge 500 has markings 550 on it, either in inches or centimeters, to assist with setting the length of the depth control gauge 500. When equipped with such markings 550, the depth guide 1 must be attached to the screed 12 at a predefined height from the roadbed 30, so that the markings correlate with the thickness of the pavement layer.

In one embodiment of the depth control gauge 500, it is comprised of an inner shaft 520 and an outer sleeve 530. The inner shaft 520 is inserted into the outer sleeve 530 and is capable of moving at least partially within the outer sleeve 530, such that when a greater portion of the inner shaft 520 is exposed exterior to the outer sleeve 530 the overall length of the depth control gauge 500 is increased, and when a smaller portion of the inner shaft 520 is exposed exterior to the outer sleeve 530 the overall length of the depth control gauge 500 is decreased. See FIGS. 2A, 2B, and 2C. In this embodiment, the markings 550 may be placed on the exterior of the inner shaft 520, so that as more of the inner shaft 520 is exposed exterior to the outer sleeve 530 more of the markings 550 are likewise exposed, indicating the depth. In this embodiment, the means for fixing the length of the depth control gauge 500 is a set screw 540. Other means, such as a bolt and wingnut assembly, or even a tight friction fit of the inner shaft 520 within the outer sleeve 530, may be used.

Figure 4:
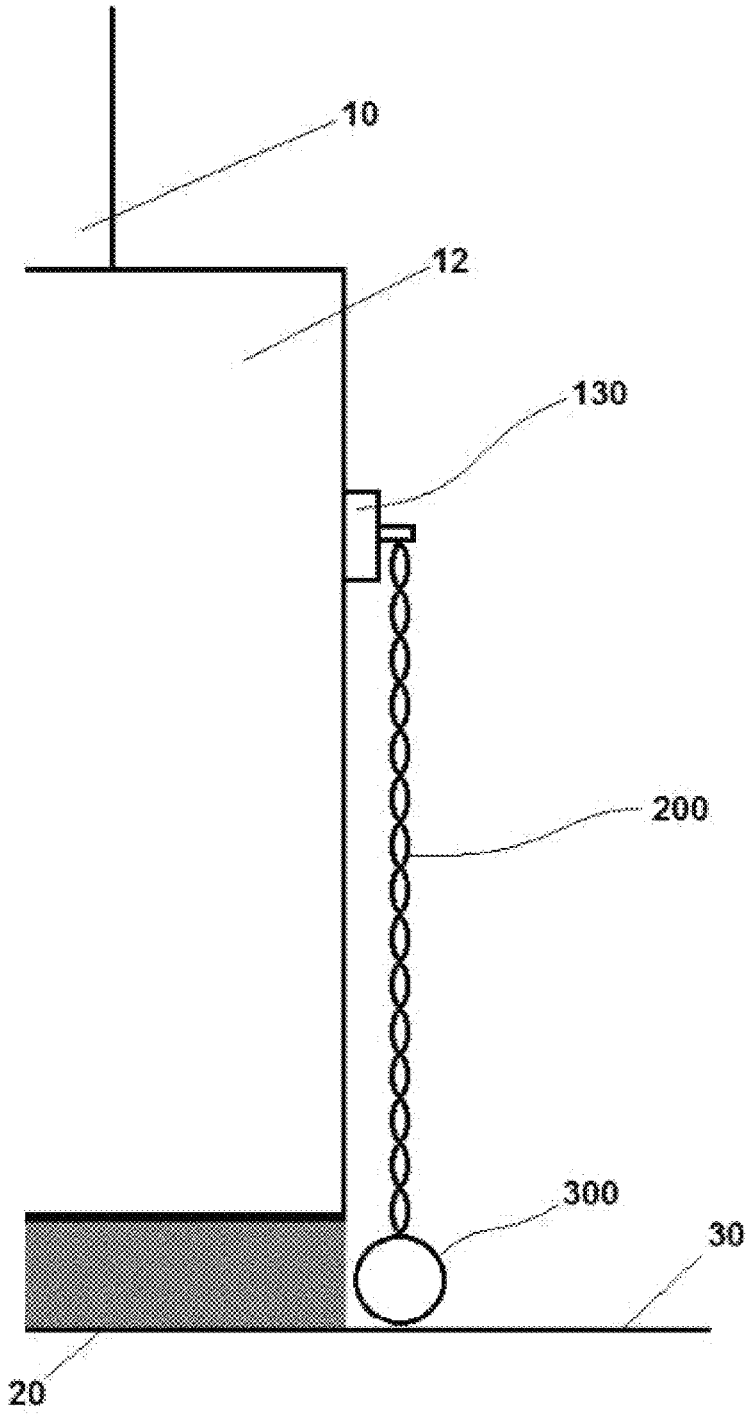
FIG. 4 is a plan rear view of another embodiment of the present invention, depicting the depth guide of the present invention removably attached to the side of a stylized screed with a magnet.

In an alternative embodiment of the depth guide 1, the attachment component 100 is removably attached to the screed 12. This can be achieved by securing a bracket to the side of the screed 12, with several different attachment points arranged vertically on the bracket, and the attachment component 100 being placed onto whichever attachment point corresponds to the desired thickness of the pavement layer. In another embodiment, the attachment component 100 is removably attached to the screed 12 by use of one or more magnets 130. See FIG. 4. The magnet 130 is integrated with the attachment component 100 and is placed onto the side of the screed 12 at the appropriate height. The magnet 130 may be a rare-earth-element magnet, such as a nickel-coated neodymium-iron-boron magnet. In this embodiment, no depth control gauge 500 is needed because the proper position of the depth guide 1 is determined by the position of the magnet 130 on the screed 12. Use of an extension arm 400 is optional with this configuration.

Figure 3A:
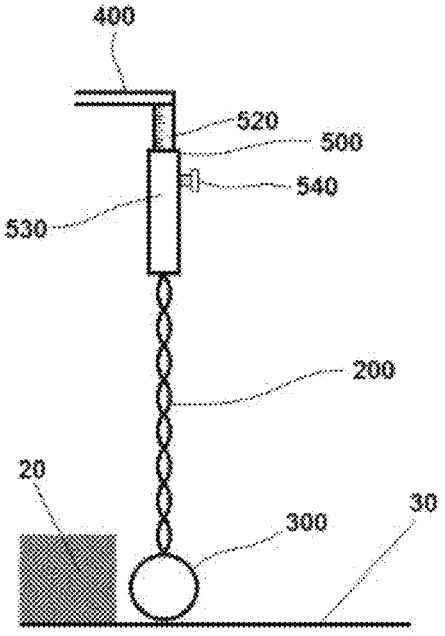
FIG. 3A depicts the embodiment of the present invention shown in FIG. 1, with the depth control gauge set at an intermediate height, corresponding to the screed forming a pavement layer of intermediate thickness.
Figure 3B:
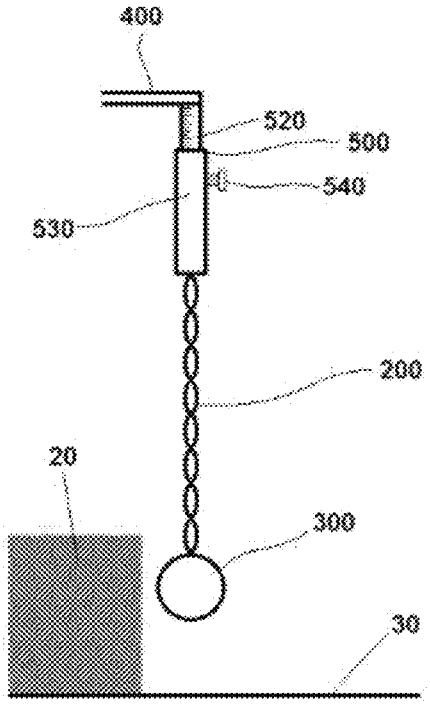
FIG. 3B depicts the embodiment of the present invention shown in FIG. 3A, whereby an excess amount of road paving material has been deposited on the roadbed, thereby causing the distal indicator to rise an excess distance above the roadbed. This provides an immediate visual indication to the operator that an excess amount of road paving material has been deposited on the roadbed and formed into a pavement layer.
Figure 3C:
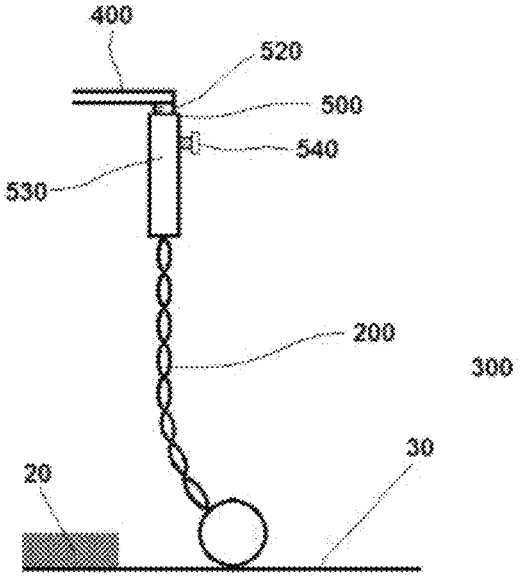
FIG. 3C depicts the embodiment of the present invention shown in FIG. 3A, whereby an insufficient amount of road paving material has been deposited on the roadbed, thereby causing the distal indicator to lay directly on the roadbed and the depth indicator to go slack. This provides an immediate visual indication to the operator that an insufficient amount of road paving material has been deposited on the roadbed and formed into a pavement layer.

Once the depth control gauge 500 is properly set (or the magnet 130 of the attachment component 100 is properly positioned), the operator of the road paving machine 10 begins depositing road paving material 20 onto the roadbed 30. See FIG. 5. As the screed 12 forms the road paving material 20 into a pavement layer of the proper thickness, the distal end 212 of the depth indicator 200 (or the bottom of the distal indicator 300) hangs just over the roadbed 30, as shown in FIG. 3A. However, if during operation the roadbed 30 varies, for example, there is a dip, and too much road paving material 20 is formed into an overly thick pavement layer, the distal end 212 of the depth indicator 200 (or the bottom of the distal indicator 300) will rise off the roadbed 30, as shown in FIG. 3B. The operator will see this and will compensate by lowering the screed 12 until the distal end 212 of the depth indicator 200 (or the bottom of the distal indicator 300) again hangs just over the roadbed 30. If, on the other hand, too little road paving material 20 is formed into an overly thin pavement layer, the distal end 212 of the depth indicator 200 (or the bottom of the distal indicator 300) will come into contact with the roadbed 30 and the depth indicator 200 will go slack, as shown in FIG. 3C. The operator will see this and will compensate by raising the screed 12, until the distal end 212 of the depth indicator 200 (or the bottom of the distal indicator 300) again hangs just over the roadbed 30. This dynamic resetting of the height of the screed 12 continues throughout operation of the road paving machine 10, ensuring a pavement layer of the proper thickness.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A depth guide for use on a road paving machine, said road paving machine having a screed attached thereto capable of depositing road paving material onto a roadbed, said screed being adjustable in height to control the thickness of a pavement layer formed from road paving material deposited onto the roadbed, said depth guide comprising an attachment component, said attachment component adapted to attach said depth guide to the screed; and a depth indicator, said depth indicator being elongate and having a length, a proximate end, and a distal end, said depth indicator being attached at its proximate end to the screed by the attachment component, said depth indicator extending in a downward direction from the attachment component towards the roadbed;

whereby the distal end of the depth indicator is visually perceived by an operator of the road paving machine during operation of the road paving machine, such that proximity of the distal end of the depth indicator to the roadbed provides the operator with information regarding the thickness of the road paving material that has been deposited onto the roadbed and formed into the pavement layer by the screed.

2. The depth guide of claim 1 wherein the depth indicator is flexible.

3. The depth guide of claim 2 wherein the depth indicator is a length of chain.

4. The depth guide of claim 2 further comprising a distal indicator, wherein said distal indicator is attached to the distal end of the depth indicator, said distal indicator having a greater dimension than the distal end of the depth indicator, thereby facilitating viewing by the operator of the road paving machine during operation of the road paving machine, and said distal indicator having sufficient mass to extend the depth indicator substantially to its full length.

5. The depth guide of claim 4 wherein the distal indicator is spherical.

6. The depth guide of claim 1 wherein the attachment component is fixedly attached to the screed.

7. The depth guide of claim 6 wherein the attachment component is attached to the screed by one or more mechanical fasteners.

8. The depth guide of claim 6 wherein the attachment component is attached to the screed by one or more welds.

9. The depth guide of claim 1 wherein the attachment component is removably attached to the screed.

10. The depth guide of claim 9 wherein the attachment component is attached to the screed by use of one or more magnets.

11. The depth guide of claim 1 further comprising an extension arm, said extension arm being elongate and having a proximate end and a distal end, said extension arm being interposed between the attachment component and the depth indicator, with the proximate end of the extension arm being attached to the attachment component and with the proximate end of the depth indicator being attached to the distal end of the extension arm;

whereby the extension arm is adapted to position the depth indicator away from the screed such that the operator of the road paving machine can more easily visually perceive the distal end of the depth indicator.

12. The depth guide of claim 11 wherein the extension arm is oriented substantially horizontally.

13. The depth guide of claim 11 wherein the extension arm is pivotally attached to the attachment component;

whereby the distal end of the extension arm is adapted to swing away from and towards the screed.

14. The depth guide of claim 11 further comprising a depth control gauge, said depth control gauge being elongate and having an adjustable length and a proximate end and a distal end, said depth control gauge being interposed between the distal end of the extension arm and the proximate end of the depth indicator, with the proximate end of the depth control gauge being attached to the distal end of the extension arm and with a proximate end of the depth indicator being attached to the distal end of the depth control gauge, and with the depth control gauge being oriented substantially vertically, with said depth control gauge having associated therewith a first length and a second length, with said second length being longer than the first length, and a means for adjusting the length of the depth control gauge to the first length or to the second length or to a plurality of intermediate lengths, each intermediate length longer than the first length and shorter than the second length, with said depth control gauge further having a means for fixing the length of the depth control gauge at the length to which it is adjusted;

whereby the length of the depth control gauge is adjusted to set the position of the distal end of the depth indicator a desired height above the roadbed.

15. The depth guide of claim 14 wherein the depth control gauge incorporates markings to assist in establishing the height of the distal end of the depth indicator above the roadbed.

16. The depth guide of claim 14 wherein the depth control gauge comprises an inner shaft and an outer sleeve, wherein the inner shaft is inserted into the outer sleeve and is capable of moving at least partially within the outer sleeve, such that when a greater portion of the inner shaft is exposed exterior to the outer sleeve the overall length of the depth control gauge is increased and when a smaller portion of the inner shaft is exposed exterior to the outer sleeve the overall length of the depth control gauge is decreased; and the means for fixing the length of the depth control gauge is adapted to stop the movement of the inner shaft relative to the outer sleeve.

17. The depth guide of claim 16 wherein the means for fixing the length of the depth control gauge is a set screw.

18. The depth guide of claim 1 further comprising a depth control gauge, said depth control gauge being elongate and having an adjustable length and a proximate end and a distal end, said depth control gauge being interposed between the attachment component and the proximate end of the depth indicator, with the proximate end of the depth control gauge being attached to the attachment component and with a proximate end of the depth indicator being attached to the distal end of the depth control gauge, and with the depth control gauge being oriented substantially vertically, with said depth control gauge having associated therewith a first length and a second length, with said second length being longer than the first length, and a means for adjusting the length of the depth control gauge to the first length or to the second length or to a plurality of intermediate lengths, each intermediate length longer than the first length and shorter than the second length, with said depth control gauge further having a means for fixing the length of the depth control gauge at the length to which it is adjusted;

whereby the length of the depth control gauge is adjusted to set the position of the distal end of the depth indicator a desired height above the roadbed.

19. The depth guide of claim 18 wherein the depth control gauge incorporates markings to assist in establishing the height of the distal end of the depth indicator above the roadbed.

20. A depth guide for use on a road paving machine, said road paving machine having a screed attached thereto capable of depositing road paving material onto a roadbed, said screed being adjustable in height to control the thickness of a pavement layer formed from road paving material deposited onto the roadbed, said depth guide comprising an attachment component, said attachment component adapted to fixedly attach said depth guide to the screed;

an extension arm, said extension arm being elongate and having a proximate end and a distal end, with the proximate end of the extension arm being attached to the attachment component, said extension arm being oriented substantially horizontally, said extension arm being pivotally attached to the attachment component;

a depth control gauge, said depth control gauge being elongate and having an adjustable length and a proximate end and a distal end, with the proximate end of the depth control gauge being attached to the distal end of the extension arm, and with the depth control gauge being oriented substantially vertically, with said depth control gauge having associated therewith a first length and a second length, with said second length being longer than the first length, and a means for adjusting the length of the depth control gauge to the first length or to the second length or to a plurality of intermediate lengths, each intermediate length longer than the first length and shorter than the second length, with said depth control gauge having a means for fixing the length of the depth control gauge at the length to which it is adjusted, and the depth control gauge incorporating markings to assist in establishing the height of the distal end of the depth indicator above the roadbed;

a depth indicator, said depth indicator being elongate and having a length, a proximate end, and a distal end, said depth indicator being attached at its proximate end to the distal end of the depth control gauge, said depth indicator extending in a downward direction from the attachment component towards the roadbed, said depth indicator being a flexible length of chain; and a distal indicator, said distal indicator being attached to the distal end of the depth indicator, said distal indicator being spherical and having a greater dimension than the distal end of the depth indicator, thereby facilitating viewing by the operator of the road paving machine during operation of the road paving machine, said distal indicator having sufficient mass to extend the depth indicator substantially to its full length;

whereby the extension arm is adapted to swing away from the screed to position the depth indicator away from the screed such that the operator of the road paving machine can more easily visually perceive the distal indicator, the length of the depth control gauge is adjusted to set the position of the distal indicator a desired height above the roadbed, and the distal indicator is visually perceived by an operator of the road paving machine during operation of the road paving machine, such that proximity of the distal indicator to the roadbed provides the operator with information regarding the thickness of the road paving material that has been deposited onto the roadbed and formed into the pavement layer by the screed.

* * * * *